US008684689B2

(12) United States Patent
Guo et al.

(10) Patent No.: US 8,684,689 B2
(45) Date of Patent: Apr. 1, 2014

(54) TURBOMACHINE SHROUD

(75) Inventors: Changsheng Guo, South Windsor, CT (US); Dustin Frame, Glastonbury, CT (US); Tania Bhatia Kashyap, Middletown, CT (US); Paul F. Croteau, Columbia, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 530 days.

(21) Appl. No.: 13/006,488

(22) Filed: Jan. 14, 2011

(65) Prior Publication Data

US 2012/0183394 A1 Jul. 19, 2012

(51) Int. Cl.
*F01D 25/28* (2006.01)

(52) U.S. Cl.
USPC ..... 415/213.1

(58) Field of Classification Search
USPC ..... 415/173.1, 173.2, 173.3, 173.4, 136, 415/138, 139, 173.5, 213.1
See application file for complete search history.

(56) References Cited

U.S. PATENT DOCUMENTS

| | | | | |
|---|---|---|---|---|
| 4,076,451 | A | 2/1978 | Jankot | |
| 5,071,313 | A * | 12/1991 | Nichols | 415/134 |
| 5,137,421 | A | 8/1992 | Hayton | |
| 5,181,827 | A | 1/1993 | Pellow et al. | |
| 5,494,402 | A | 2/1996 | Glezer et al. | |
| 5,791,871 | A | 8/1998 | Sech et al. | |
| 6,833,233 | B2 | 12/2004 | Cheng et al. | |
| 6,932,566 | B2 | 8/2005 | Suzumura et al. | |
| 7,195,452 | B2 * | 3/2007 | Allan et al. | 415/135 |
| 7,771,160 | B2 | 8/2010 | Shi et al. | |
| 8,167,546 | B2 * | 5/2012 | Shi et al. | 415/173.1 |
| 2006/0144050 | A1 * | 7/2006 | Williams | 60/796 |
| 2007/0128020 | A1 * | 6/2007 | Dervaux et al. | 415/209.2 |
| 2008/0145226 | A1 | 6/2008 | Gagnon et al. | |
| 2008/0304974 | A1 * | 12/2008 | Marshall et al. | 416/223 R |
| 2009/0053050 | A1 * | 2/2009 | Bruce et al. | 415/200 |

* cited by examiner

*Primary Examiner* — Nathaniel Wiehe
*Assistant Examiner* — Michael Sehn
(74) *Attorney, Agent, or Firm* — Carlson, Gaskey & Olds P.C.

(57) ABSTRACT

An example turbomachine shroud assembly includes an annular shroud configured to receive a rotating component. A radially outer surface of the annular shroud establishes positioning slots and relief slots. The positioning slots are configured to receive a support finger that limits radial movement of the annular shroud. The relief slots are different than the positioning slots.

18 Claims, 2 Drawing Sheets

TURBOMACHINE SHROUD

BACKGROUND

This disclosure relates generally to a turbomachine shroud and, more particularly, to distributing stress in an annular turbomachine shroud.

Turbomachines extract energy from a flow of fluid as is known. During operation, air is pulled into the turbomachine. The air is then compressed and combusted. The products of combustion expand to rotatably drive a turbine section of the turbomachine. As known, shrouds (or blade outer air seals) seal against rotating components of the turbomachines. Sealing interfaces between the rotating components and the shrouds increases engine efficiencies.

One example turbomachine is an auxiliary power unit (APU). APUs are typically located in the tail sections of large aircraft. The APUs provides electrical power and compressed air to the aircraft. APUs, and other turbomachines, experience extreme temperatures during operation. Shrouds in the APUs, which are typically annular and formed of a single piece, must accommodate these temperatures to maintain sealing interfaces with other components.

Shrouds made from ceramic materials particularly silicon-based ceramics such as silicon carbide (SiC) and silicon nitride ($Si_3N_4$) offer unique benefits by enabling tighter tip clearances and therefore improved efficiency. Additionally ceramic materials are refractory and allow for the design of highly efficient turbomachines. However, ceramic materials are brittle and need to be designed with specific considerations to mitigate the risks associated with flaw sensitivity of the material.

SUMMARY

An example turbomachine shroud assembly includes an annular shroud configured to receive a rotating component. A radially outer surface of the annular shroud establishes positioning slots and relief slots. The positioning slots are configured to receive a support finger that limits radial movement of the annular shroud. The relief slots are different than the positioning slots.

The turbomachine shroud may comprise of ceramic materials such as silicon carbide, silicon nitride, silicon carbonitride, glass-ceramics, oxide ceramics etc.

An example turbomachine assembly includes a component configured to rotate about an axis. A shroud is configured to receive the component. A clamp ring has fingers that extend axially and are received within positioning slots established in the shroud to limit radial movement of the shroud relative to the clamp ring. The shroud establishes at least one relief slot.

An example method of distributing stresses within a shroud includes establishing positioning slots within a shroud. The positioning slots are configured to receive fingers that position shroud assembly relative to turbomachine centerline and limit radial movement of the shroud relative to the fingers. The method establishes relief slots in the shroud that are different than the positioning slots.

These and other features of the disclosed examples can be best understood from the following specification and drawings, the following of which is a brief description.

DETAILED DESCRIPTION

Figure 1:
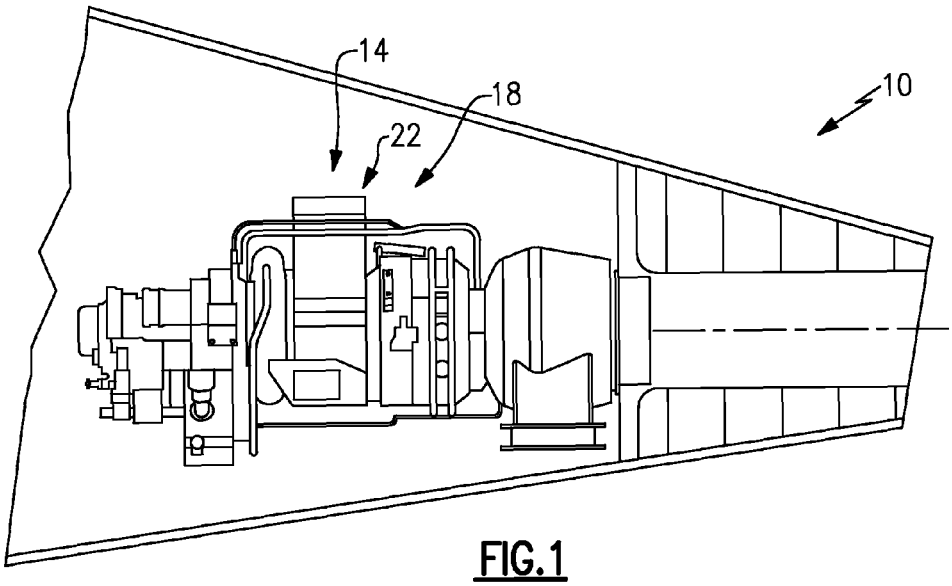
FIG. 1 shows a side view of an auxiliary power unit within a tail section of an aircraft.

Referring to FIG. 1, a tail section 10 of an aircraft houses an auxiliary power unit (APU) 14, which is an example type of turbomachine. The APU 14 is used to provide power and pressurized air for use in the aircraft. Although shown in the tail section 10 of an aircraft, a person having skill in this art and the benefit of this disclosure will understand that the APU 14 could be located elsewhere within the aircraft.

During operation, compressed air moves from a compression section 18 of the APU 14 to a turbine section 22 of the APU 14. As known, the APU 14 includes various other components to assist in its operation.

Figure 2:
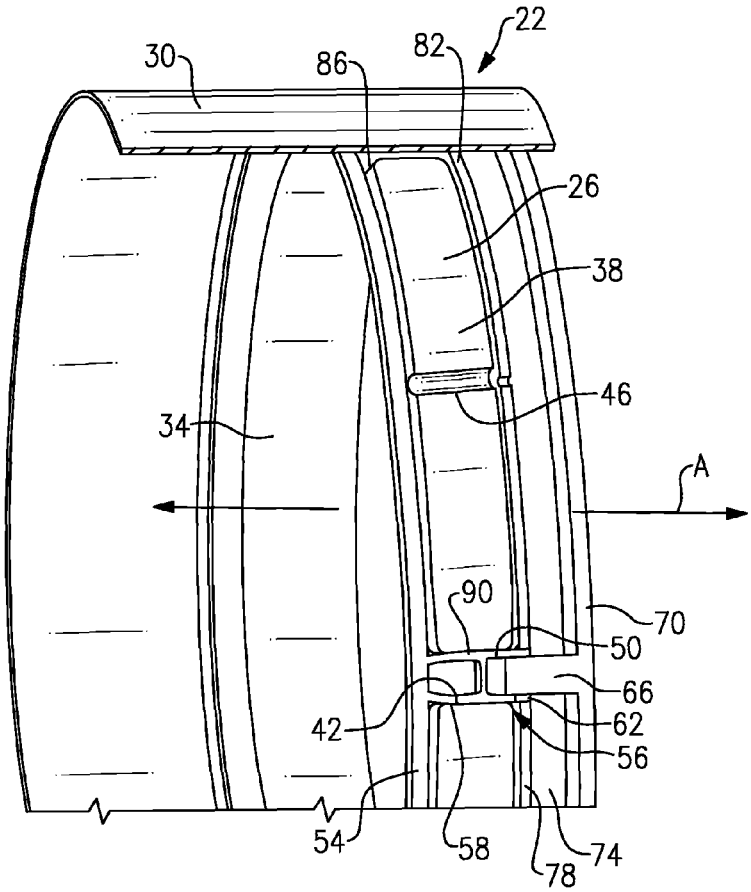
FIG. 2 shows a partially cutaway view of a turbine section of the FIG. 1 auxiliary power unit.
Figure 3:
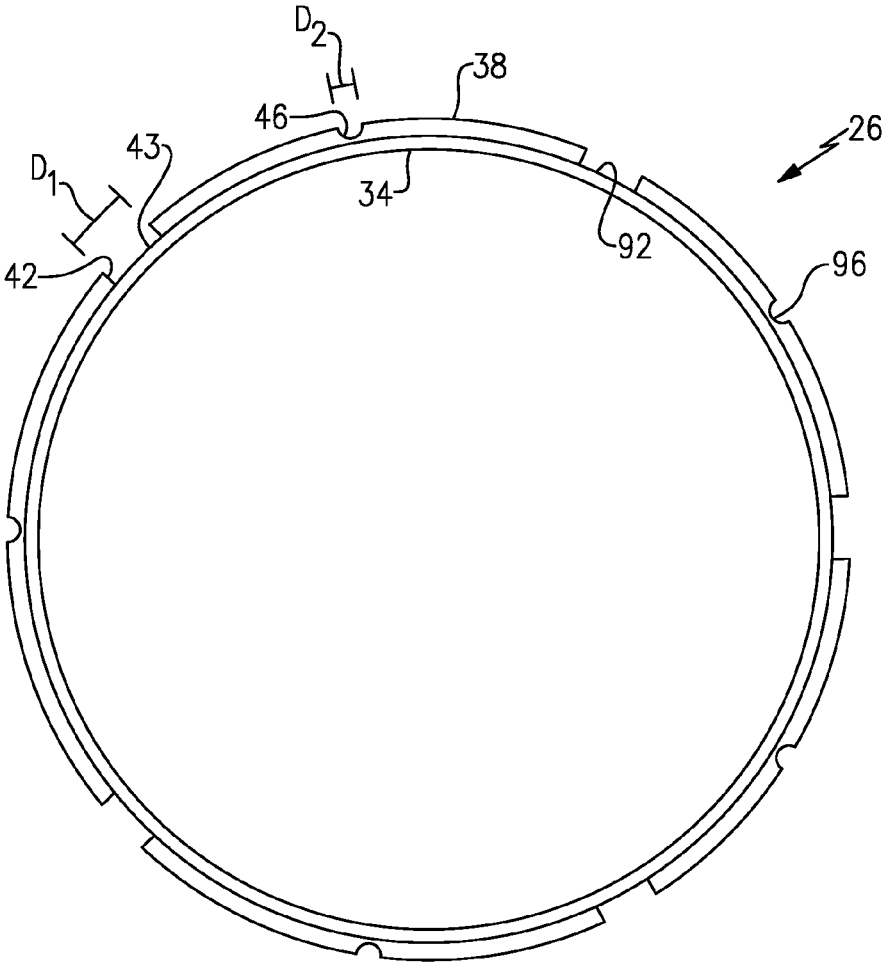
FIG. 3 shows an end view of a shroud in the FIG. 1 auxiliary power unit.
Figure 4:
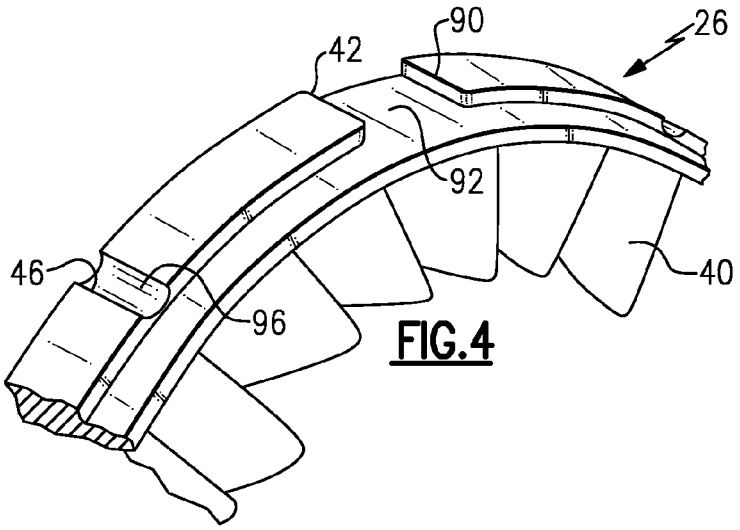
FIG. 4 shows a perspective view of a portion of the FIG. 3 shroud interfacing with a rotatable component.

Referring now to FIGS. 2-4 with continuing reference to FIG. 1, the turbine section 22 of the APU 14 includes a shroud assembly 26 (or blade outer air seal) positioned within a turbine support case 30. The example shroud assembly 26 is an annular shroud that establishes an axis A. The shroud assembly 26 includes a radially inner surface 34 and a radially outer surface 38. In this example, the shroud assembly 26 is roughly cast, and then machined to finished dimensions. The example shroud assembly 26 is a monolithic ceramic structure.

The radially inner surface 34 seals against a component 40 that rotates about the axis, such as blades in a blade array during operation. Other example shroud assemblies seal against other types of rotating components. A person having skill in the art and the benefit of this disclosure would understand how to machine an inner surface that seals against a rotating component.

The outer surface 38 of the shroud assembly 26 establishes a plurality of positioning slots 42 and a plurality of relief slots 46. The positioning slots 42 are each sized to receive a finger 50 of a clamp ring 54. The finger 50 contacts the sides of the positioning slots 42 to limit radial movement of the shroud assembly 26. In this example, the axial ends of the positioning slots 42 have the same width. In another example, an axial end 56 of the positioning slots 42 is larger than the other axial end.

One end 58 of the finger 50 is secured to a main portion of the clamp ring 54. An opposing end 62 of the finger 50 is configured to engage with a tab 66 of a clip ring 70. A wave spring 74, a spring support ring 78, and the shroud assembly 26 are sandwiched axially between the clamp ring 54 and the clip ring 70 when the finger 50 is engaged with the tab 66.

The example shroud 26 is made of a ceramic material. The clamp ring 54 and the shroud 26 are made of a different material, such as a nickel-based superalloy like INCONEL® 909. As can be appreciated, direct contact between a ceramic and some other types of materials may not be desired. Accordingly, mica gaskets 82 and 86 are incorporated to prevent the spring support ring 78 and the clamp ring 54 from directly contacting the shroud 26.

As can be appreciated, the fingers 50 of the clamp ring 54 limit relative circumferential movement between the shroud 26 and the claim ring 54 in addition to radial movement. Plating with a soft metal, such as gold 90 may be located at the interface between the finger 50 and the shroud 26 to prevent the finger 50 from directly contacting the shroud 26.

The example shroud 26 includes five of the relief slots 46 and five of the positioning slots 42. Each of the relief slots 46 is positioned circumferentially between two adjacent positioning slots 42. The relief slots 46 have relief slot floors 96 that are rounded relative to positioning slot floors 43. In this example, the midpoints of the positioning slots 42 are located about 36 degrees away from an adjacent relief slot 46. Other examples may include more or fewer relief slots 46 or positioning slots 42. The relief slots 46 provide a hinge point or ring cross section with reduced bending stiffness for the shroud 26 to flex about during thermal expansion and retraction.

In this example, the shroud 26 has a diameter of about 7 inches (177.8 mm). The circumferential distance $D_1$ of the example positioning slots 42 is about 0.78 inches (19.8 mm). In this example, the circumferential width $D_2$ of the relief slots 46 is about 0.188 inches (4.8 mm). Other examples include positioning slots 42 and relief slots 46 that have different dimensions and profiles. The example relief slots 46 are deeper than the functional positioning slots 42, which facilitates positioning the maximum stress within the relief slots 46.

Notably, the positioning slots 42 have a floor 92 that is flatter than a floor 96 of the relief slots 46. As the relief slots 46 do not receive a substantial positioning feature, such as the finger 50, the machining and grinding of the relief slots 46 does not need to be as precise as the machining and grinding of the positioning slots 42. The geometry of the positioning slots 42 makes it challenging to achieve fine and controlled machining and grinding, which can weaken these areas of the shroud 26. The surfaces of the relief slots 46, by contrast, can be readily produced with large grinding wheels having a fine grit size.

During operation of the APU 14, the shroud 26 is exposed to extreme transient temperature gradients, which can concentrate stress in some areas of the shroud 26. In this example, the relief slots 46 of the example shroud 26 cause stress to concentrate near the relief slots 46 rather than near the positioning slots 42. As can be appreciated, areas near the relief slots 46 are of higher characteristic strength than areas near the positioning slots 42 in the example shroud.

In one example, stress on the example shroud 26 peaked at 11.0 ksi (75.84 MPa) at the floor 96 of the relief slots 46 during operation of the APU 14. The stress at the floor of the positioning slots 42 was about 8.1 ksi (55.84 MPa).

Features of the disclosed examples include adding features to a shroud that cause stresses to peak in higher strength areas of the shroud, rather than lower strength areas. Another feature of the disclosed examples includes incorporating features that require less precise machining operations to control stress than in the prior art.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A turbomachine shroud assembly, comprising:

an annular shroud configured to receive a rotatable component, a radially outer surface of the annular shroud establishing a plurality of positioning slots and a plurality of relief slots that are different than the positioning slots, the plurality of positioning slots each configured to receive a support finger that limits radial movement of the annular shroud, the plurality of positioning slots each extending across an entire axial length of the annular shroud.

2. The turbomachine shroud assembly of claim 1, wherein the annular shroud is an auxiliary power unit turbine shroud.

3. The turbomachine shroud assembly of claim 1, wherein the annular shroud is a silicon carbide, a silicon nitride, a glass ceramic, an oxide, or some combination of these.

4. The turbomachine shroud assembly of claim 1, wherein each of the plurality of relief slots is positioned between a first one of the positioning slots and a second one of the positioning slots that is circumferentially adjacent to the first one of the positioning slots.

5. The turbomachine shroud assembly of claim 1, wherein the radially outer surface of the annular shroud establishes multiple positioning slots and multiple relief slots.

6. The turbomachine shroud assembly of claim 1, wherein the relief slots and the positioning slots are aligned with an axis of the annular shroud.

7. The turbomachine shroud assembly of claim 1, including a gold-plated patch positioned circumferentially between the support finger and a surface of one of the positioning slots.

8. The turbomachine shroud assembly of claim 1, wherein a total number of positioning slots and relief slots is between three and fifteen of each.

9. The turbomachine shroud assembly of claim 1, wherein the relief slots each has a relief slot floor and the positioning slots each has a positioning slot floor, the relief slot floors are rounded relative to the positioning slot floors.

10. The turbomachine shroud assembly of claim 1, wherein areas of the shroud near the relief slots experience a higher stress than areas of the shroud near the positioning slots.

11. The turbomachine shroud assembly of claim 1, wherein the relief slot is configured to facilitate flexing of the shroud.

12. The turbomachine shroud assembly of claim 1, wherein the support finger extends axially from a clamp ring, and a gasket is positioned axially between the clamp ring and the annular shroud.

13. A turbomachine assembly, including:

a component configured to rotate about an axis;

a shroud configured to receive the component;

a clamp ring including fingers that extend axially and are received within positioning slots established within the shroud such to limit radial movement of the shroud relative to the clamp ring, wherein the shroud establishes at least one relief slot; and including a mica gasket positioned axially between the clamp ring and the shroud.

14. The turbomachine assembly of claim 13, wherein the component comprises an aircraft auxiliary power unit blade array.

15. The turbomachine assembly of claim 13, wherein the component comprises a blade array.

16. A method of distributing stresses within an annular shroud, comprising:

establishing positioning slots within an annular shroud, the positioning slots configured to receive fingers that limit radial movement of the annular shroud relative to the fingers, the plurality of positioning slots each extending across an entire axial length of the annular shroud; and establishing relief slots within the annular shroud that are different than the positioning slots.

17. The method of claim 16, wherein the annular shroud is an auxiliary power unit shroud.

18. The method of claim 16, wherein the fingers extend from a clamp ring, and a gasket is positioned axially between the clamp ring and the annular shroud.

* * * * *